US007131301B1

(12) United States Patent
Chang

(10) Patent No.: US 7,131,301 B1
(45) Date of Patent: Nov. 7, 2006

(54) LOCKING DEVICE FOR A STORAGE CABINET

(76) Inventor: Hsueh-Liang Chang, 440, Meiting Street, Taichung (TW)

( * ) Notice: Subject to any disclaimer, the term of this patent is extended or adjusted under 35 U.S.C. 154(b) by 0 days.

(21) Appl. No.: 11/233,108

(22) Filed: Sep. 23, 2005

(51) Int. Cl.
*E05B 65/06* (2006.01)
*E05B 21/00* (2006.01)

(52) U.S. Cl. ..... 70/134; 70/293; 70/294; 70/300; 70/352

(58) Field of Classification Search ..... 70/287, 70/288, 348, 213, 214, 134, 291–294, 297–300, 70/350–352, 284, 285, DIG. 1, DIG. 17, 70/DIG. 41, DIG. 71
See application file for complete search history.

(56) References Cited

U.S. PATENT DOCUMENTS 3,416,335 A * 12/1968 Barney ..... 70/134
3,640,107 A * 2/1972 Litvin ..... 70/129
3,654,783 A * 4/1972 Sinclair ..... 70/349
4,918,957 A * 4/1990 Eisermann ..... 70/276
5,025,647 A * 6/1991 Muus ..... 70/352
6,220,066 B1 * 4/2001 Haggstrom ..... 70/352
6,529,384 B1 * 3/2003 Haggstrom ..... 361/759

* cited by examiner

*Primary Examiner*—Lloyd A. Gall
(74) *Attorney, Agent, or Firm*—Posz Law Group, PLC; R. Eugene Varndell, Jr.

(57) ABSTRACT

A locking device for a storage cabinet that has a door, a cabinet body and a hook defined in the cabinet body facing the door. The locking device mounted on the door. The locking device has a body, a cylinder and a card. The body has a case, a cap and a controlling device. The case has a card slot. The cap is mounted on the case. The controlling device is mounted inside the case and connects to the cylinder. The cylinder has a cylinder body with a keyhole and a key. The card can be inserted into the card slot. When the card is inserted into the card slot, the key can be rotated to operate the lock. The method of using a card instead of coins for the operation a locking device provides convenience.

8 Claims, 7 Drawing Sheets

LOCKING DEVICE FOR A STORAGE CABINET

BACKGROUND OF THE INVENTION

1. Field of the Invention

The present invention relates to a locking device, more particularly to a locking device for a storage cabinet.

2. Description of the Related Art

Many public places provide lockable storage cabinets, or lockers, for use by the general public and most of these lockers require payment for use. A conventional pay locker has a cabinet body and a locking device. The cabinet has a door. The locking device is mounted on the door of the cabinet. When a coin is put in the locking device, the locking device can be operated. The structure of a conventional locking device is very complex and coins are almost always required to operate the locking device. The method of using a conventional locking device is inconvenient.

Thus, a real need exists for a locking device for a storage cabinet that is simple and convenient to use.

SUMMARY OF THE INVENTION

The primary objective of the present invention is to provide a locking device for a storage cabinet that is simple and convenient to use.

A locking device for a storage cabinet in accordance with the present invention is mounted on a door of the storage cabinet. The locking device has a body, a cylinder and a card. The body has a case, a cap and a controlling device. The case has a card slot. The cap is mounted on the case. The controlling device is mounted inside the case and connects to the cylinder. The cylinder has a cylinder body with a keyhole and a key. The card can be inserted into the card slot.

When the locking device is used, the card is inserted into the card slot to operate the locking device, replacing the usual coins. The key is then rotated to lock or unlock the door. This method of using a card for the operation of the locking device provides a simple and convenient way to use a pay storage locker.

Other objectives, advantages and novel features of the invention will become more apparent from the following detailed description when taken in conjunction with the accompanying drawings.

DETAILED DESCRIPTION OF THE INVENTION

Figure 1:
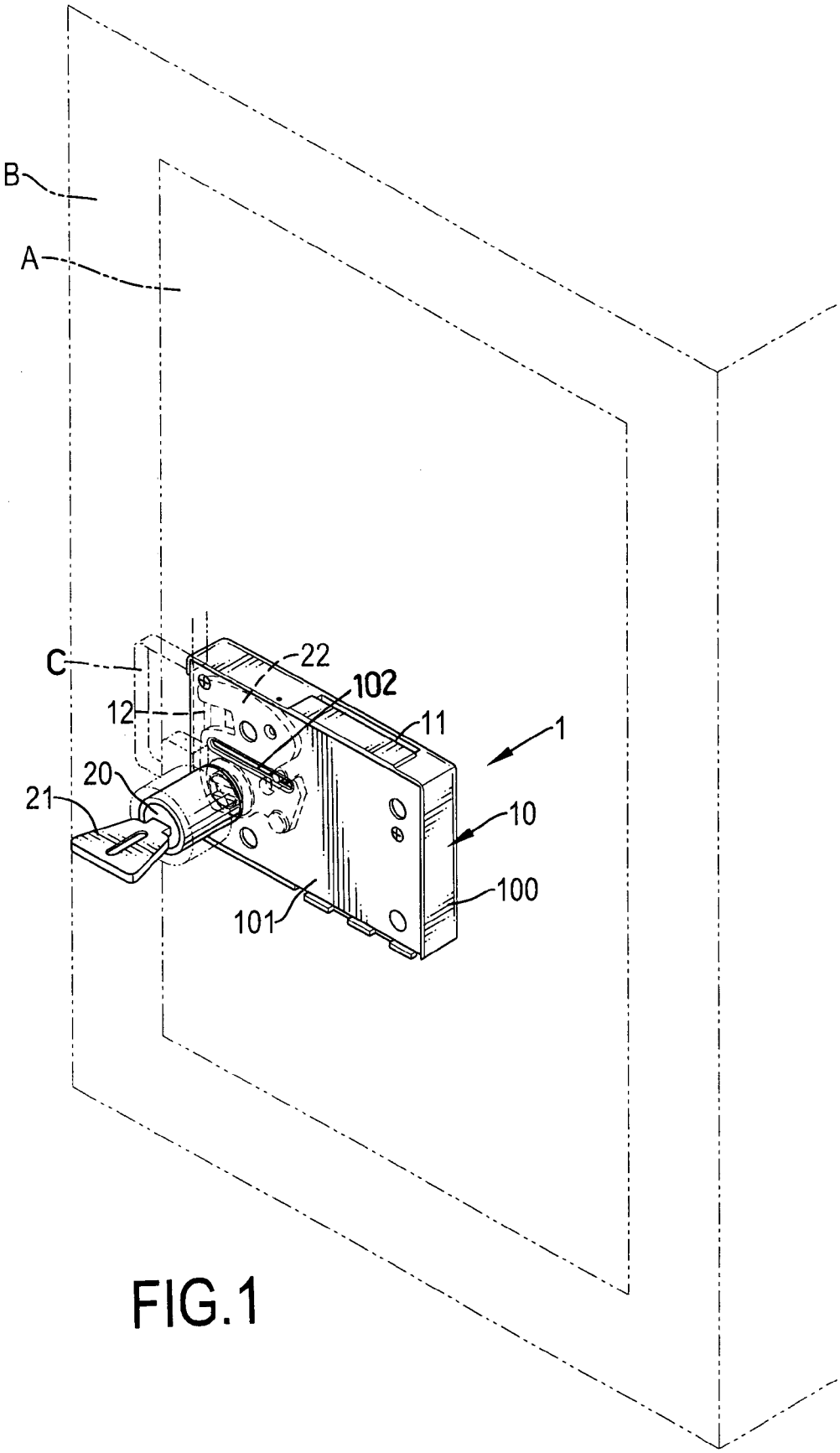
FIG. 1 is a perspective view of a first embodiment of a locking device for a cabinet in accordance with the present invention.
Figure 2:
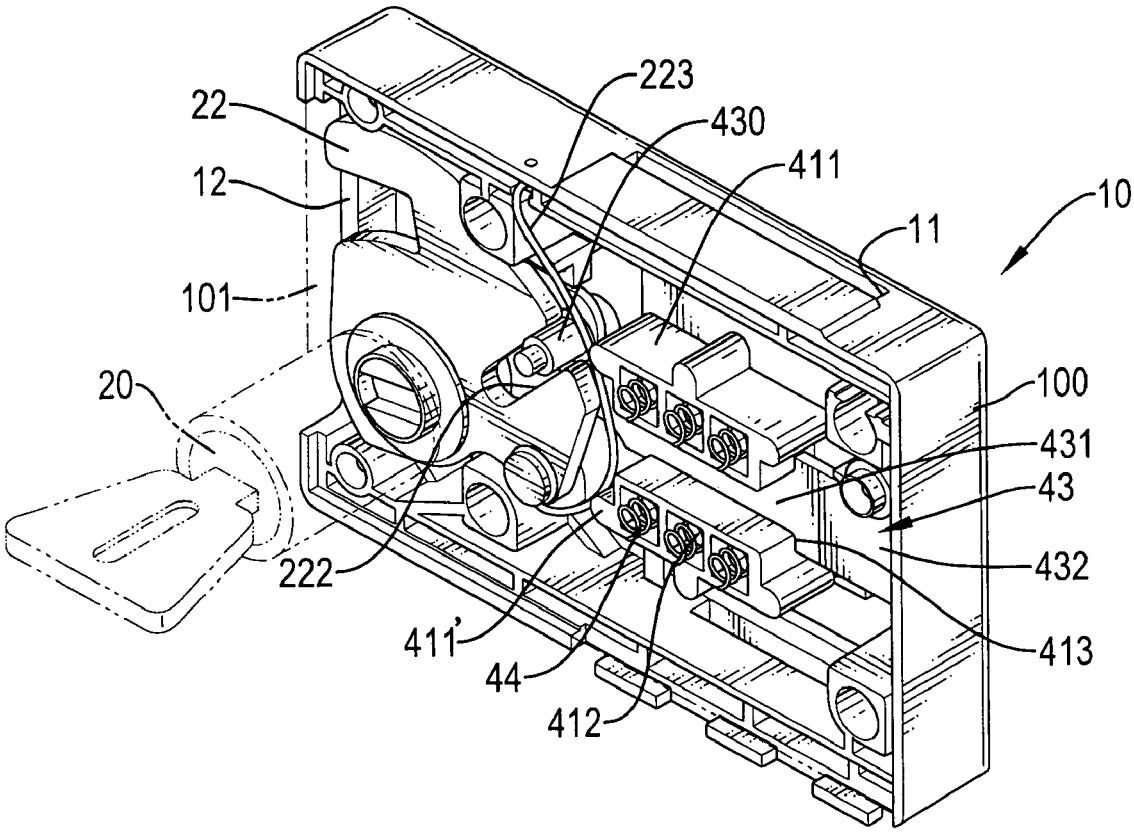
FIG. 2 is a perspective view of the locking device for a cabinet in FIG. 1 with cap and cylinder removed.
Figure 3:
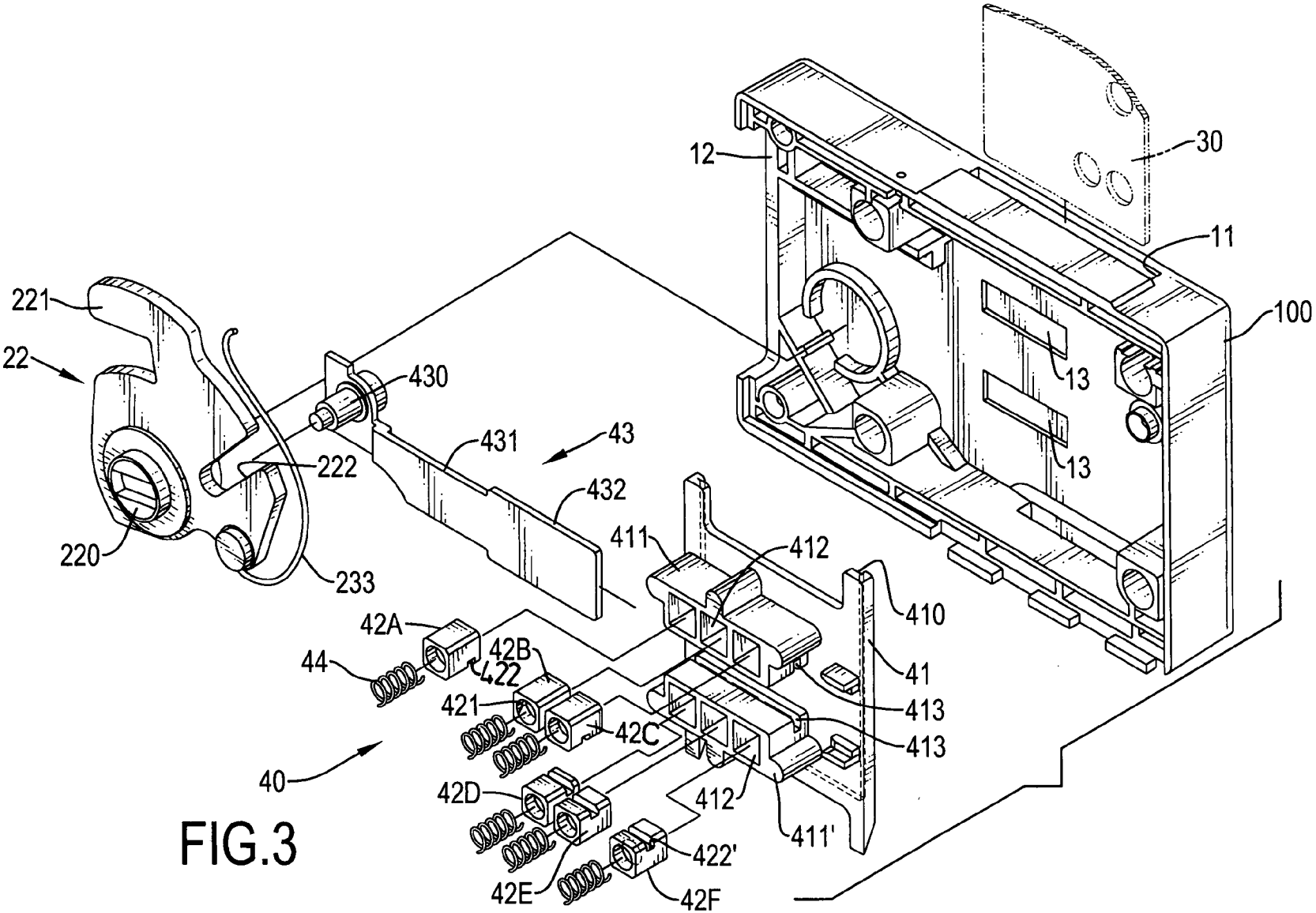
FIG. 3 is an exploded perspective view of the locking device for a cabinet in FIG. 1 when a card is not inserted inside the locking device.

With reference to FIGS. 1 to 3, a locking device (1) for a cabinet in accordance with the present invention has a body (10), a cylinder and a card (30). The cabinet has a door (A), a cabinet body (B) and a hook (C). The door (A) has an inner surface and an outer surface. The hook (C) is defined in the cabinet (B) and faces the door (A). The locking device (1) is mounted on the door (A).

The body (10) has a case (100), a cap (101) and a controlling device (40). The case (100) has a top surface, two side surfaces, a bottom surface, a front opening, an inner rear wall, an inner edge, a card slot (11), a breach (12) and two optional recesses (13). The card slot (11) is defined in the top surface of the case (100). The breach (12) is defined in one of the side surfaces of the case (100). The recesses (13) are defined in the inner rear wall of the case (100) and are parallel to each other.

The cap (101) is mounted on the front opening of the case (100) and has a horizontal slot (102) and a through hole. The horizontal slot (102) and the through hole are defined in the cap (101). The horizontal slot (102) is defined beside the through hole in the cap (101).

The controlling device (40) is mounted inside the case (100) and has a plate (41), multiple holding blocks (42), a sliding plate (43) and multiple resilient elements (44).

The plate (41) is mounted on the inner rear wall of the case (100) and has a front surface, a rear surface, a receiving holder (410), an upper housing (411), a lower housing (411'), multiple channels (412) and a keyway (413). The receiving holder (410) is defined on the rear surface of the plate (41) and communicates to the card slot (11) in the case (100). The upper housing (411) and the lower housing (411') are mounted on the front surface of the plate (41) and are opposite each other. The multiple channels (412) are defined in the housings (411, 411') and defined through the plate (41). The multiple channels (412) face to each other. In a preferred embodiment, each housing (411, 411') has three channels (412). The keyway (413) is defined between the two housings (411, 411') for holding the sliding plate (43).

Figure 4:
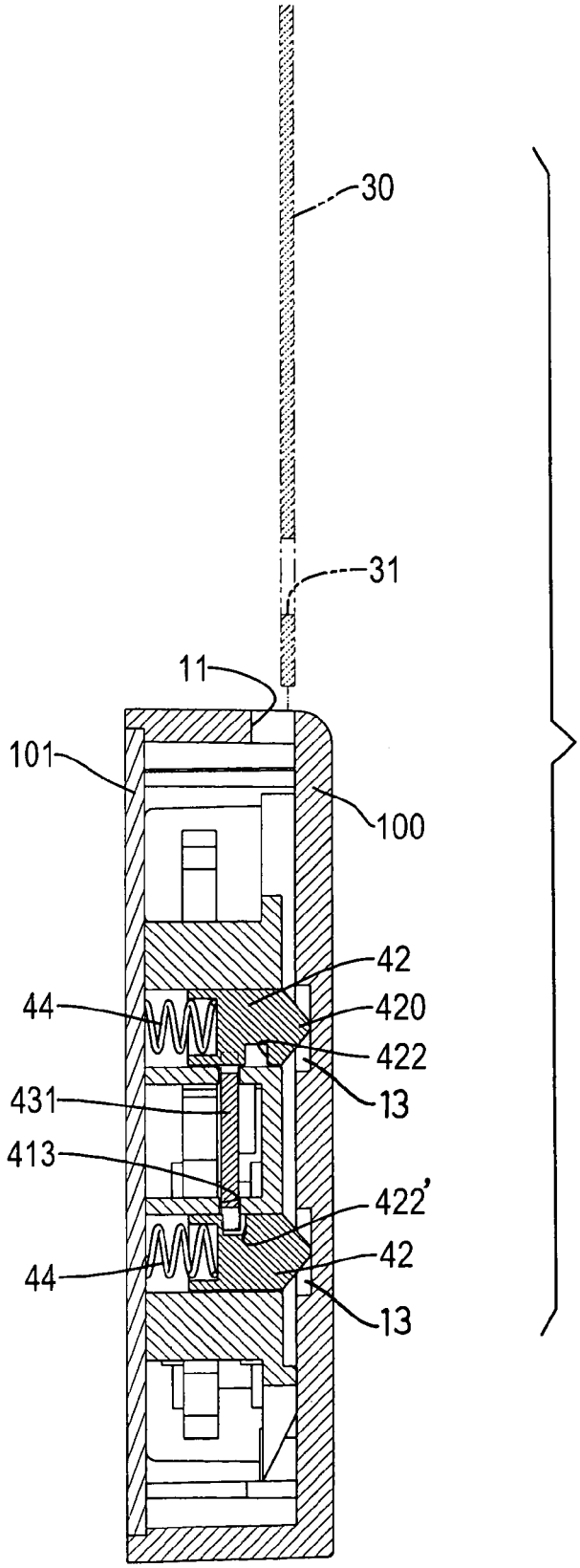
FIG. 4 is a side view in cross section of the locking device for a cabinet in FIG. 1 when a card is not inserted inside the locking device.

With further reference to FIG. 4, the multiple holding blocks (42) are mounted respectively inside the channels (412). Each holding block (42) has an outer surface, an inner end (420), an outer end, an optional receiving recess (421) and a sliding groove (422, 422'). The inner end (420) is formed as a taper. The receiving recess (421) is defined in the outer surface. The sliding groove (422, 422') is defined in the outer surface of the holding block (42). The sliding grooves (422, 422') in the holding blocks (42) do not align with each other when the inner ends (420) of the holding blocks (42) abut the recesses (13) in the case (100). In three alternative embodiment, the sliding grooves (422, 422') in the holding blocks (42) received inside the channels (412) in the upper housing (411) are not aligned to each other, the sliding grooves (422, 422') in the holding blocks (42) received inside the channels (412) in the lower housing (411') are not aligned to each other or the sliding grooves (422,422') in at least one pair of aligned holding blocks (42) received inside the channels (412) in the upper and the lower housing (411, 411') are not aligned to each other. In a preferred embodiment, three holding blocks (42A, 42B, 42C) are respectively mounted inside the channels (412).

Two of the three holding blocks (42A, 42B) received inside the upper housing (411) have an inner sliding groove (422) respectively near the inner ends (420) of the holding blocks (42), while the third holding block (42C) has an outer sliding groove (422) near the outer end of the holding block (42C). Also, two of the three holding blocks (42E, 42F) received inside the lower housing (411') have an outer sliding groove (422'), while the other holding block (42D) has an inner sliding groove (422). The sliding grooves (422, 422') in the first and the last holding blocks (42A, 42D, 42C, 42F) received inside the upper and lower housing (411, 411') face each other, while the sliding grooves (422, 422') in the central holding blocks (42B, 42E) received inside the upper and the lower housing (411, 411') do not face each other. The distance between the inner sliding groove (422) and the outer sliding groove (422') is about the thickness of the card (30).

The sliding plate (43) mounted inside the case (100) has a post (430), a tongue (431) and two lips (432).

Figure 5:
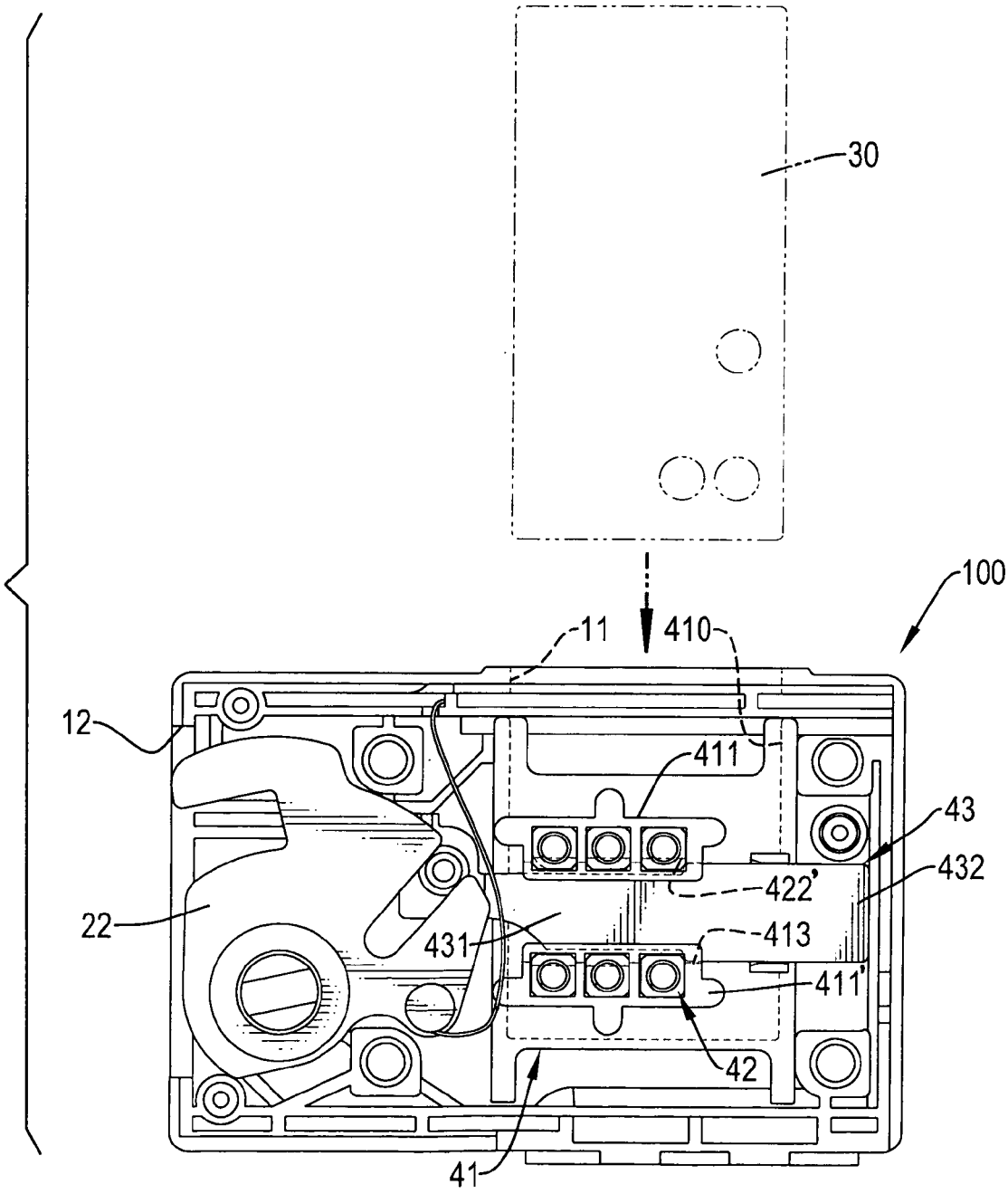
FIG. 5 is a front view of the locking device for a cabinet in FIG. 1 when a card is not inserted inside the locking device.

With further reference to FIG. 5, the post (430) is mounted on the sliding plate (43) and extends out of the horizontal slot (102) in the cap (101). The post (430) is aligned with and can move along the horizontal slot (102). The tongue (431) has two side edges and a distal end. The two lips (432) are formed respectively on the side edges of the tongue (431) at the distal end. The tongue (431) is mounted slidably inside the sliding grooves (422, 422') and the lips (432) may engage and be stopped by some of the holding blocks (42).

The resilient elements (44), which can be coil springs, are mounted respectively inside the recesses (412) and abut the cap (101). The resilient elements (44) are used for biasing the holding blocks (42).

The cylinder is mounted on the door (A) and has a cylinder body (20) and a rotating plate (22).

The cylinder body (20) is mounted on the outer surface of the door (A) and extends from the outer surface of the door (A) and the through hole in the cap (101). The cylinder body (20) has an inner end, an outer end, a keyhole and a key (21). The keyhole is defined in the outer end of the cylinder body (20). The key (21) is inserted in the keyhole as usual.

The rotating plate (22) is pivotally mounted in the case (100) at the inner end of the cylinder body (20) and connects to the sliding plate (43). In a preferred embodiment, the rotating plate (22) engages the post (430) of the sliding plate (43). The rotating plate (22) has a top edge, a bottom edge, an optional head (220), an arm (221), an optional engaging slot (222) and an optional resilient spring (223). The head (220) is defined in the rotating plate (22) where upon the inner end of the cylinder body (20) is mounted. The arm (221) is formed on the top edge of the rotating plate (22). The engaging slot (222) is defined in the rotating plate (22) and corresponds to the post (430) on the sliding plate (43) to engage the post (430). The resilient spring (223) is mounted on the bottom edge of the rotating plate (22) and has two ends. One end of the resilient spring (223) is attached to the rotating plate (22), and the other end is attached to the inner edge of the case (100).

The card (30), which can be inserted into the card slot (11) in the case (100), has multiple through holes (31) defined in the card (30). Each through hole (31) corresponds to a holding block (42) that has an outer sliding groove (422'), so that the inner end (420) of the holding block (42) can protrude through the through hole (31).

Figure 6:
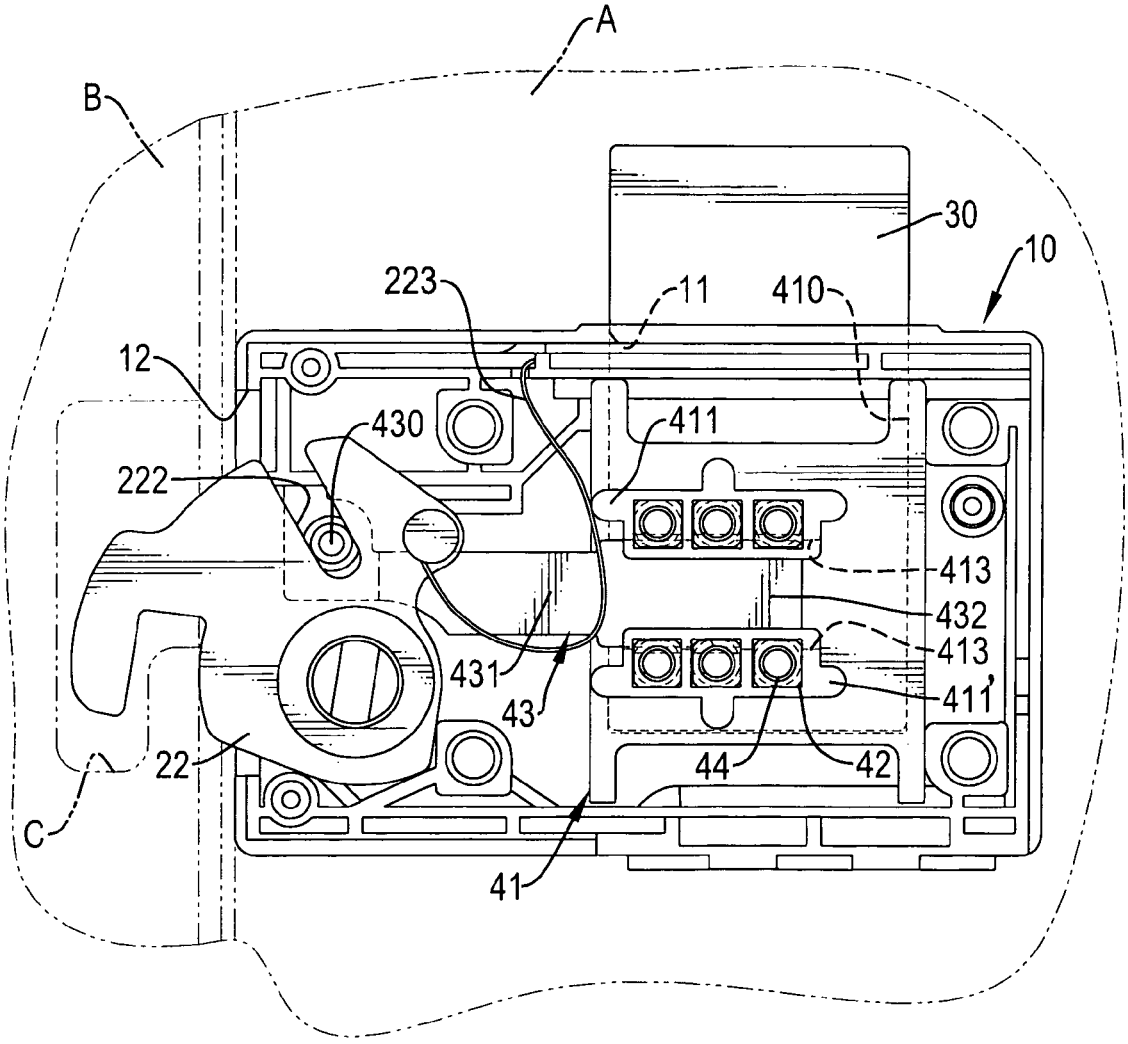
FIG. 6 is a front view of the locking device for a cabinet in FIG. 1 when a card is inserted inside the locking device and the locking device is locked.
Figure 7:
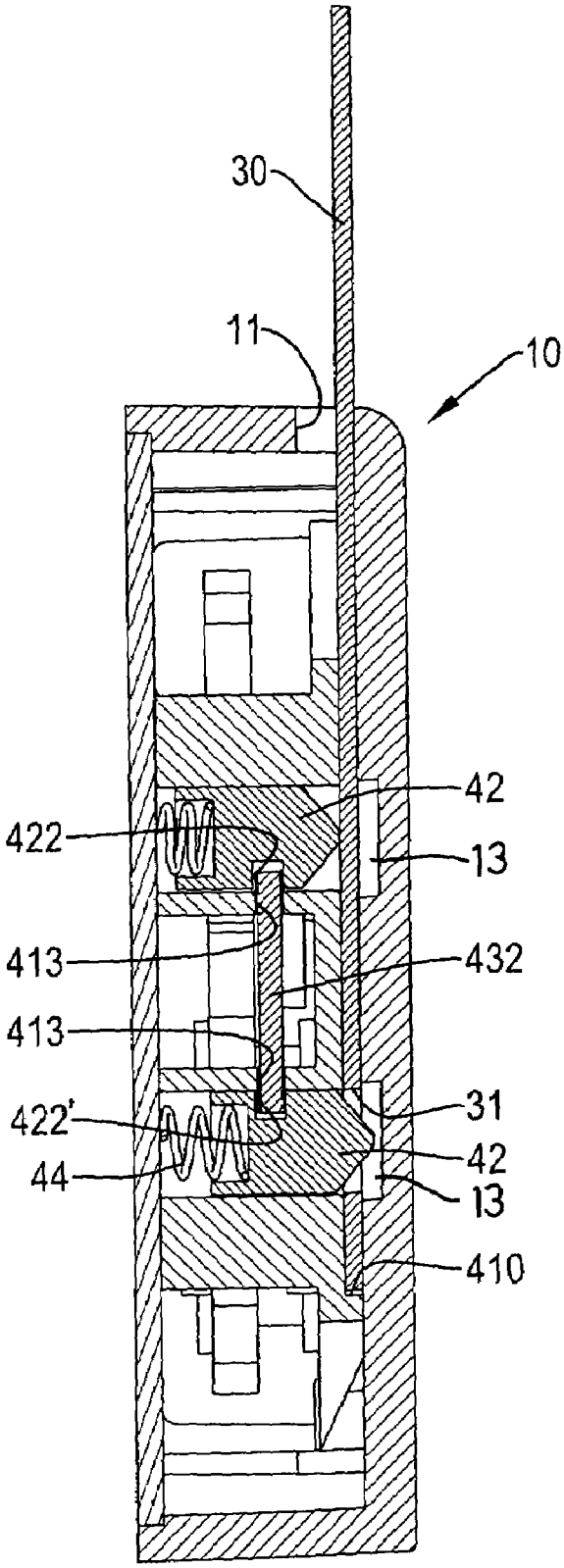
FIG. 7 is a side view of the locking device for a cabinet in FIG. 1 when a card is inserted inside the locking device and the locking device is locked.

With reference to FIGS. 5 to 7, when the cabinet (B) is used and it is to be locked, the card (30) is inserted into locking device (1) through the card slot (11). The card (30) pushes against the inner ends (420) of the holding blocks (42) and forces the holding blocks (42) back into the housings (411, 411'). The holding blocks (42) that have an outer sliding groove (422') protrude through the corresponding through holes (31) on the card (30) and return to their original position. However, the holding blocks (42) that have an inner sliding groove (422) are held back in the housings (411, 411'). Thus the case inner sliding grooves (422) and the outer sliding grooves (422') of the holding blocks (42) become aligned with each other. This allows the sliding plate (43) to slide freely along the sliding groove (422, 422') so that the lock device (1) can be used. When the key (21) is rotated, the rotating plate (22) is also rotated with the key (21) and the arm (221) hooks into the hook (C) in the cabinet (B). The rotating plate (22) will pull the sliding plate (43) along the sliding groove (422, 422') now that it is no longer stopped by the holding blocks (42), and finally, the cabinet (B) is locked and the key (21) can be removed.

The advantage of the locking device (1) for a storage cabinet in accordance with the present invention is as follows:

The invention offers convenience as a user would no longer need to prepare coins to use the locking device. Furthermore, the locking device for a storage cabinet doesn't need a container for storing coins, so the structure of the locking device for a storage cabinet is simpler than the conventional one.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A locking device for a cabinet that has a door, a cabinet body and a hook defined in the cabinet body and facing to the door, the locking device for being mounted on the door, comprising a body having a case having a top surface, two side surfaces, a bottom surface, a front opening, an inner rear wall, an inner edge, a card slot defined in the top surface of the case, and a breach defined in one of the side surfaces of the case, a cap mounted on the front opening of the case and having a horizontal slot defined in the cap, and a through hole defined in the cap beside the horizontal slot, and a controlling device mounted inside the case, and having a plate mounted on the inner rear wall of the case and having a front surface, a rear surface, a receiving holder defined on the rear surface of the plate and communicating to the card slot in the case, an upper housing mounted on the front surface of the plate, a lower housing mounted on the front surface of the plate opposite the upper housing, multiple channels respectively defined in the housings through the plate and facing to each other, and a keyway defined between the two housings, multiple holding blocks respectively received inside the corresponding channels, each holding block having an outer surface, an inner end, an outer end, and a sliding groove defined in the outer surface of the holding block, wherein the sliding grooves in the holding blocks are not aligned with each other when the inner end abuts a recess in the case, a sliding plate mounted inside the case and having a tongue having two side edges, and a distal end, and two lips formed respectively on the side edges of the tongue at the distal end and engaging at least one of the holding blocks, a cylinder adapted for mounting on the door, having a cylinder body extending from the through hole in the cap, having an inner end, an outer end, a keyhole defined in the outer end of the cylinder body, and a key inserted inside the keyhole, and a rotating plate pivotally mounted inside the case at the inner end of the cylinder body and connecting to the sliding plate, having a top edge, a bottom edge, an arm formed on the top edge of the rotating plate and adapted for engaging with the hook, and a card inserted into the card slot in the case and having multiple through holes defined in the card and corresponding to the sliding groove in the holding blocks.

2. The locking device for a cabinet as claimed in claim 1, wherein the sliding plate has a post formed on the sliding plate, and the rotating plate has an engaging slot defined in the rotating plate corresponding to the post on the sliding plate for engaging the post.

3. The locking device for a cabinet as claimed in claim 2, wherein the inner end of each holding block is a taper, and each holding block further comprises a recess defined in the outer end, and a resilient element mounted inside the recess and abutting the cap.

4. The locking device for a cabinet as claimed in claim 1, wherein the inner end of each holding block is a taper, and each holding block further comprises a recess defined in the outer end, and a resilient element mounted inside the recess and abutting the cap.

5. The locking device for a cabinet as claimed in claim 4, wherein the rotating plate further comprises a resilient spring having two ends, one end of the resilient spring attached to the bottom edge of the rotating plate, the other end attached to the inner edge of the case.

6. The locking device for a cabinet as claimed in claim 5, in which three holding blocks are received respectively inside the channels in the upper housing, and three holding blocks are received respectively inside the channels in the lower housing and aligning respectively with the holding blocks in the upper housing, wherein the sliding grooves in the holding blocks received inside the channels in the upper housing are not aligned to each other.

7. The locking device for a cabinet as claimed in claim 5, in which three holding blocks are received respectively inside the channels in the upper housing, and three holding blocks are received respectively inside the channels in the lower housing and aligning respectively with the holding blocks in the upper housing, wherein the sliding grooves in the holding blocks received inside the channels in the lower housing are not aligned to each other.

8. The locking device for a cabinet as claimed in claim 5, in which three holding blocks are received respectively inside the channels in the upper housing, and three holding blocks are received respectively inside the channels in the lower housing and aligning respectively with the holding blocks in the upper housing, wherein the sliding grooves in at least one pair of aligned holding blocks received inside the channels in the upper and the lower housing are not aligned to each other.

* * * * *